US007426933B2

(12) United States Patent
Palm et al.

(10) Patent No.: US 7,426,933 B2
(45) Date of Patent: Sep. 23, 2008

(54) DISHWASHER WITH KINETIC ENERGY WATER DISTRIBUTION SYSTEM

(75) Inventors: Mark E. Palm, Jackson, TN (US); Michael J. Kramer, Jackson, TN (US); Kristen K. Hedstrom, Humboldt, TN (US)

(73) Assignee: Maytag Corporation, Benton Harbor, MI (US)

( * ) Notice: Subject to any disclaimer, the term of this patent is extended or adjusted under 35 U.S.C. 154(b) by 445 days.

(21) Appl. No.: 10/671,370

(22) Filed: Sep. 25, 2003

(65) Prior Publication Data

US 2005/0066998 A1 Mar. 31, 2005

(51) Int. Cl.
*B08B 3/02* (2006.01)
*B05B 3/04* (2006.01)
*B05B 3/10* (2006.01)

(52) U.S. Cl. ..... 134/183; 134/200; 239/222.17

(58) Field of Classification Search ..... 134/182, 134/183, 198, 200; 239/222.17
See application file for complete search history.

(56) References Cited

U.S. PATENT DOCUMENTS 2,024,952 A * 12/1935 Snyder et al. ..... 134/58 D
2,707,475 A 5/1955 Walker et al.
3,051,184 A 8/1962 Gibson
3,067,759 A 12/1962 Guth et al.
3,176,697 A * 4/1965 Gibson ..... 134/183
3,288,156 A * 11/1966 Jordan et al. ..... 134/176
3,292,645 A * 12/1966 Braden et al. ..... 134/57 D
3,368,573 A 2/1968 Mixon
3,496,949 A 2/1970 Mercer
3,809,106 A 5/1974 Crabtree
5,546,968 A 8/1996 Jeon et al.
5,651,380 A 7/1997 Sargeant et al.
5,673,714 A 10/1997 Campagnolo et al.
5,755,244 A * 5/1998 Sargeant et al. ..... 134/46
6,260,565 B1 * 7/2001 Welch et al. ..... 134/200

FOREIGN PATENT DOCUMENTS

DE 1 183 214 12/1964
EP 0 593 876 A1 8/1993
EP 1 232 720 A2 11/2001
FR 1335909 A * 8/1963

OTHER PUBLICATIONS

Electronic translation of FR 1335909.*

* cited by examiner

*Primary Examiner*—Joseph L. Perrin
(74) *Attorney, Agent, or Firm*—John Morrison; Michael D. LaFrenz

(57) ABSTRACT

An improved water distribution system is provided for a dishwasher. The system includes one or more disks mounted in the dishwasher for rotation about a vertical axis, and one or more water nozzles in the dishwasher for directing a water jet onto the disks. The water jets are directed transverse to the axis of rotation of the disks so as to impart rotation to the disks, and thereby redirect the water jet to a radial direction for distribution in the washing chamber of the dishwasher. Thus, the linear kinetic energy of the water jet is transferred to radial kinetic energy by the rotating disk.

12 Claims, 4 Drawing Sheets

DISHWASHER WITH KINETIC ENERGY WATER DISTRIBUTION SYSTEM

BACKGROUND OF THE INVENTION

Dishwashers typically include upper and lower rotatable spray arms operatively connected to a water manifold to distribute water within the washing chamber for cleaning the objects in the dishwasher racks. These conventional spray arm water distribution systems are relatively complex in construction, with moving parts and precise connections. Such complexity increases the manufacturing costs, and thus the cost to the consumer.

Accordingly, a primary objective of the present invention is a simplified water distribution system for dishwashers.

Another objective of the present invention is the provision of a dishwasher having a kinetic energy water distribution system.

A further objective of the present invention is the provision of a dishwasher which directs a water jet with linear kinetic energy onto a disk which distributes the water jet with radial kinetic energy.

Yet another objective of the present invention is the provision of a method of distributing water in a dishwasher by transferring linear kinetic energy of a water jet into radial kinetic energy.

Another objective of the present invention is the provision of a method of distributing water in a wash chamber wherein a water jet is directed in a linear path onto a rotating disk for redirecting the water in to a radial direction, with the linear and radial directions being co-planer.

A further objective of the present invention is the provision of an improved method of distributing water in a dishwasher using a horizontal jet of water.

Another objective of the present invention is the provision of an improved dishwasher which is economical to manufacture and durable and efficient in use.

These and other objectives will become apparent from the following description of the invention.

SUMMARY OF THE INVENTION

The dishwasher of the present invention includes a washing chamber defined by opposite side walls, a bottom wall, a top wall, a back wall, and a door. A disk is mounted in the top wall for rotation about a vertical axis and includes a plurality of vanes. A water nozzle is provided on the back wall of the chamber to direct a water jet horizontally onto the vanes of the disk so as to rotate the disk and thereby redirect the water radially for distribution in the washing chamber. Accordingly, the initial linear kinetic energy of the water jet is converted to radial kinetic energy upon impact with the disk. The water jet is directed substantially horizontally from the nozzle onto the disk, so as to be substantially perpendicular to the rotational axis of the disk. Accordingly, the linear and radial kinetic energies reside in a common plane.

DETAILED DESCRIPTION OF THE DRAWINGS

Figure 1:
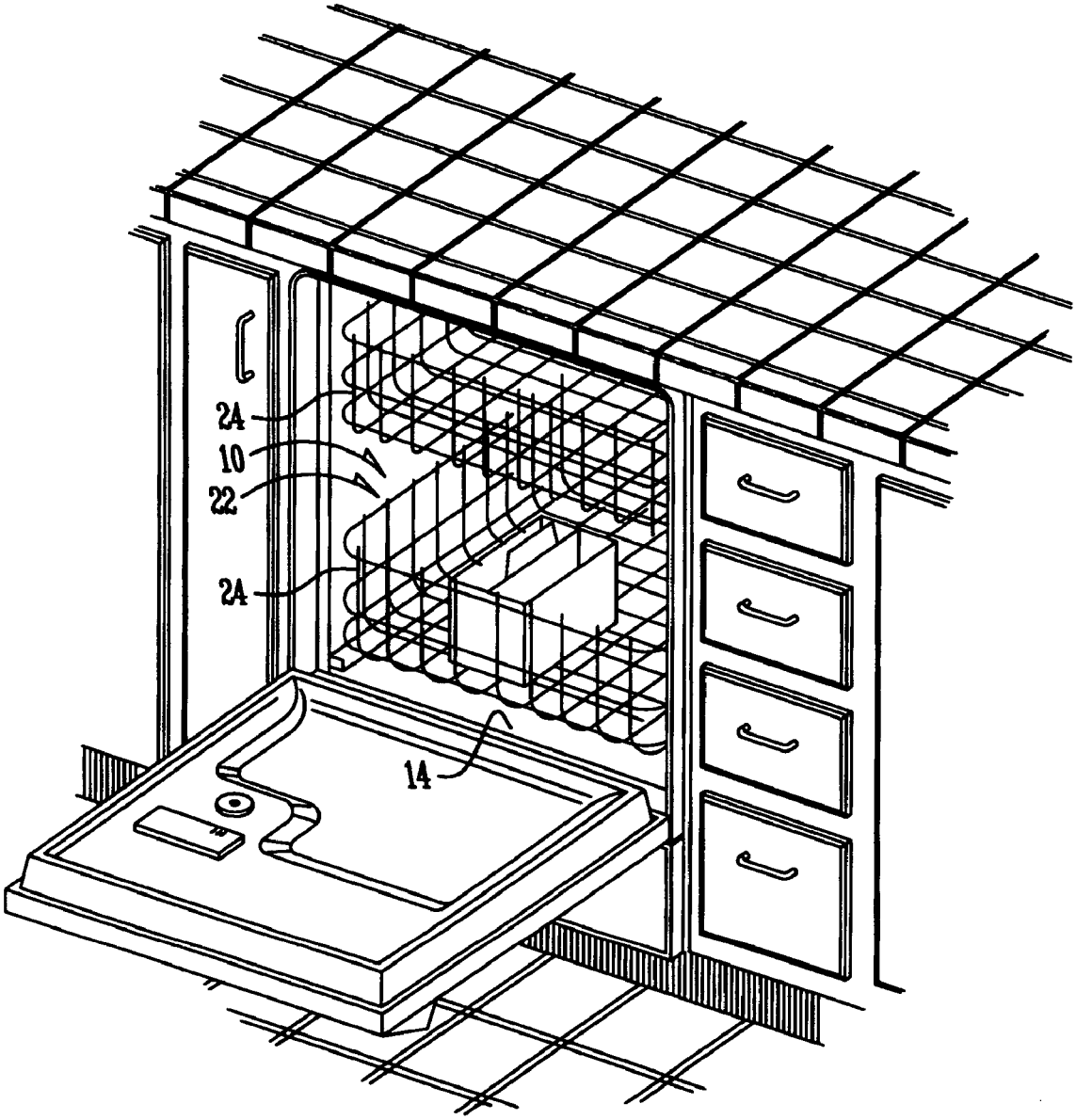
FIG. 1 is a perspective view of a dishwasher mounted under a kitchen counter, with the door open and having a pair of racks positioned in the washing chamber.

The dishwasher of the present invention is generally designated by the reference numeral 10 in the drawings. As seen in FIG. 1, the dishwasher 10 includes opposite sidewalls 12, a bottom wall 14, a top wall 16, a back wall 18, and a door 20. The walls 12, 14, 16, 18 and the door 20 define a washing chamber 22 in which racks 24 are positioned for washing objects in the racks 24.

The above description of the dishwasher 10 is conventional, and does not form part of the present invention.

Figure 2:
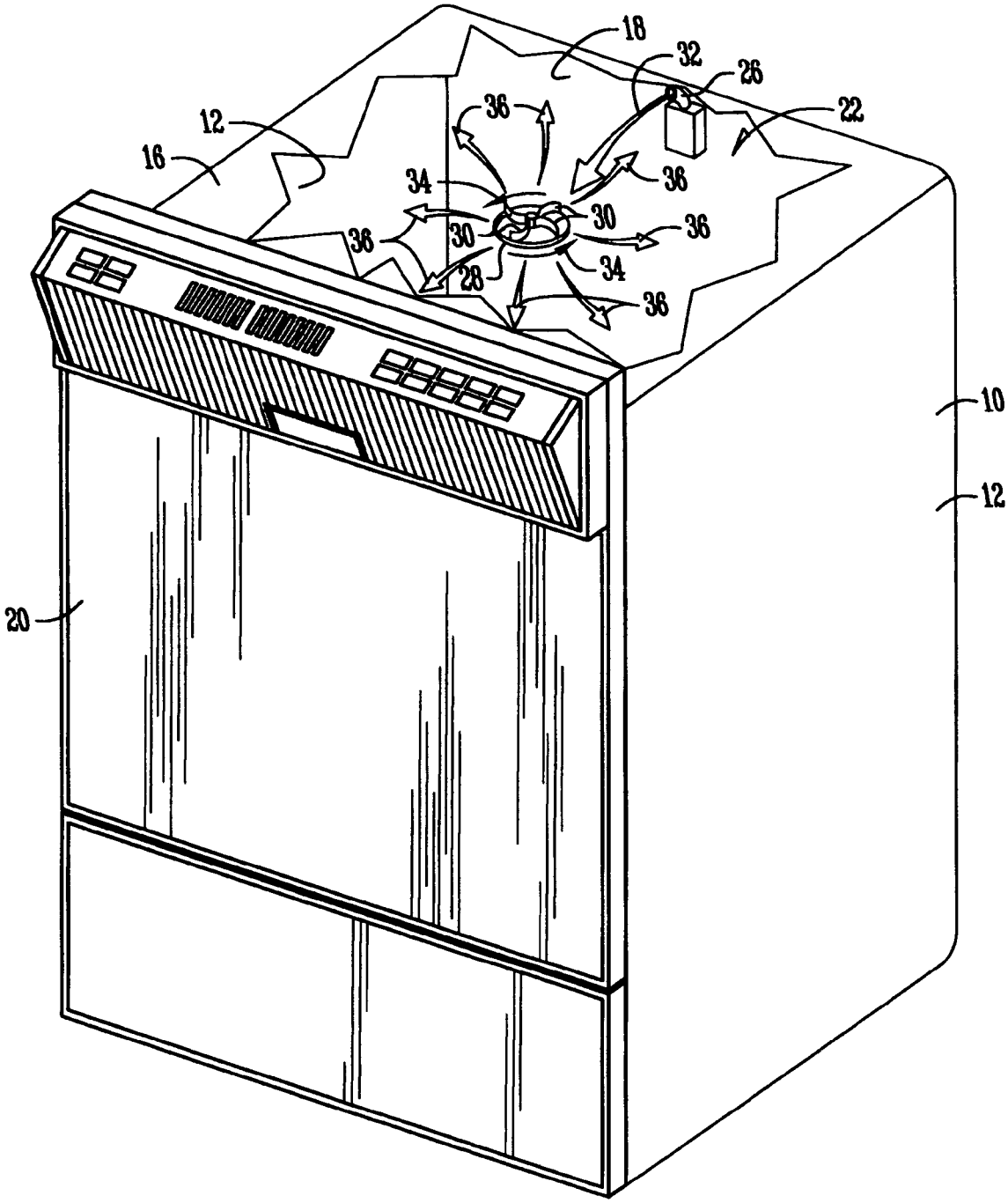
FIG. 2 is a perspective view showing the dishwasher with a portion of the top wall broken out to show the water distribution system of the present invention.

The present invention is directed towards the water distribution system for the dishwasher 10. More particularly, the water distribution system includes a water nozzle 26 mounted in the back wall 18 adjacent the top wall 16, as seen in FIG. 2. A disk 28 is mounted in the top wall 16 for rotation about a vertical axis. The disk 28 includes a plurality of vanes 30.

In operation, a water jet is emitted from the water nozzle 26 in a substantially horizontal direction, as indicated by arrow 32, so as to have linear kinetic energy. The water jet impinges upon the vanes 30 of the disk 28, thereby rotating the disk 28, as indicated by the arrows 34. The rotation of the disk 28 redirects the water jet in a radial pattern, as indicated by arrows 36, such that the water is distributed throughout the chamber 22. Thus, the linear kinetic energy of the water jet is transferred to radial kinetic energy by the rotating disk 28. The linear and radial kinetic energies are substantially co-planer, since the water jet is directed substantially perpendicular to the rotational axis of the disk 28.

Figure 3:
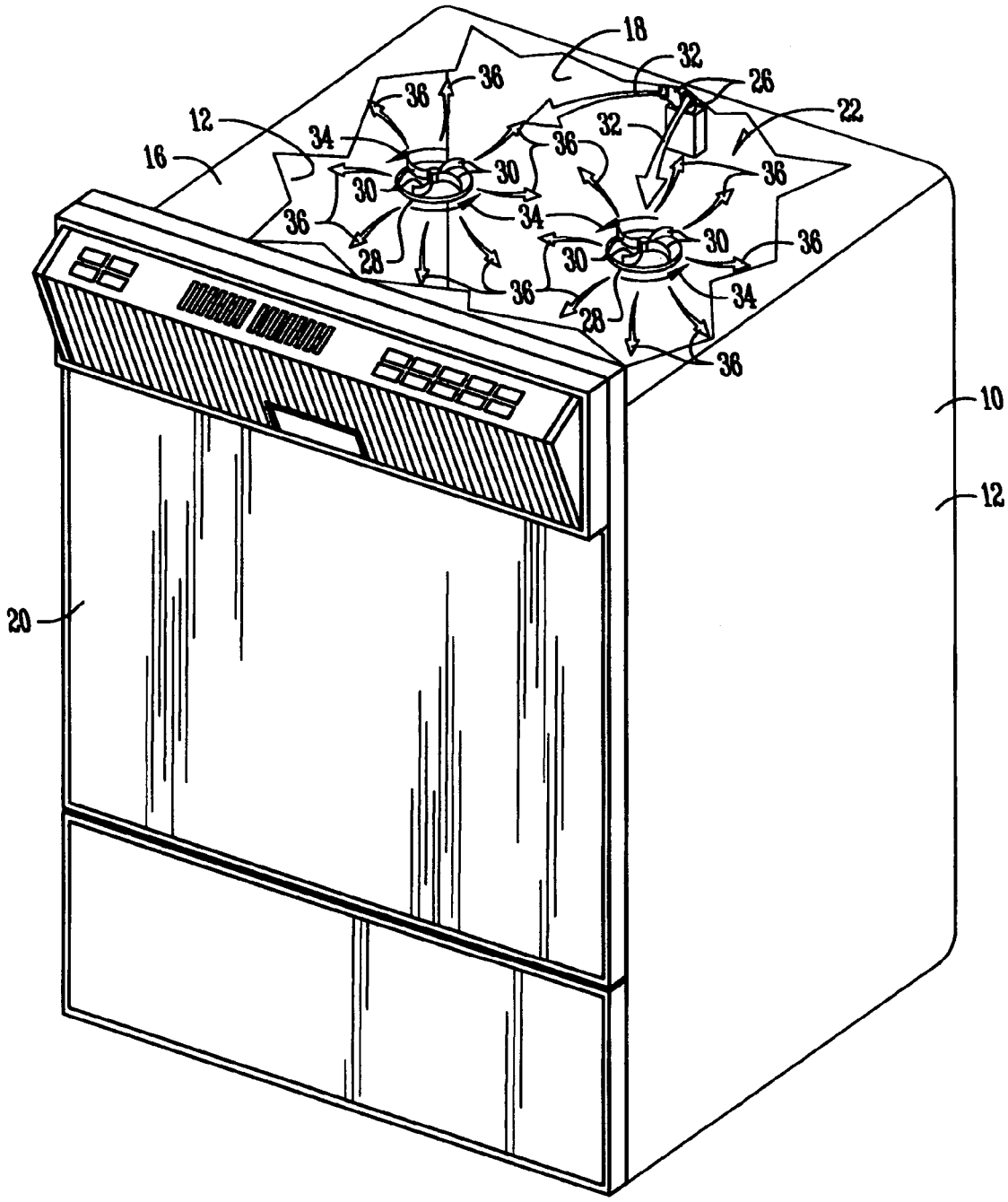
FIG. 3 is a view similar to FIG. 2 showing a water distribution system utilizing a pair of water nozzles and a pair of rotating disks in accordance with an alternative embodiment of the present invention.

FIG. 3 shows an alternative embodiment of the present invention wherein a pair of water nozzles 26 are provided on the back wall 18 for directing two water jets onto a pair of rotatable disks 28 mounted in the top wall 16. Each nozzle 26 directs a water jet to one of the disks 28, as indicated by the arrows 32, with the disks rotating in the direction shown by arrows 34 so as to transfer the linear water flow to a radial flow as indicated by arrows 36, for distribution of the water onto objects contained in the racks 24.

Figure 4:
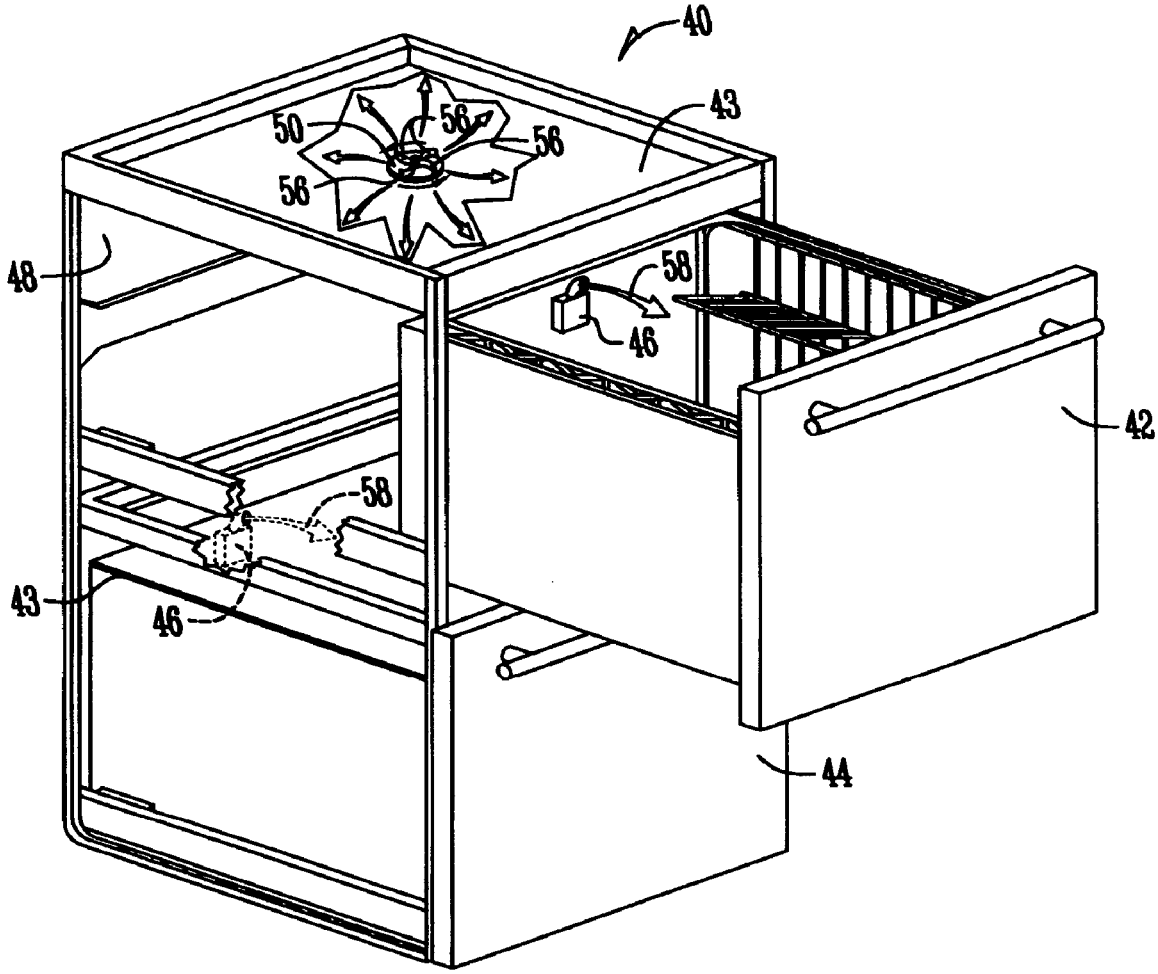
FIG. 4 is a perspective view of a drawer-style dishwasher having the water distribution system of the present invention.

FIG. 4 shows a perspective view of a drawer-style dishwasher 40 with an upper drawer 42 and a lower drawer 44. Each drawer 42, 44 includes racks for holding dishes and other objects to be washed. Each drawer 42, 44 is adapted to move between an open position when the drawer is pulled out, a seen with drawer 42 in FIG. 4, and a closed position when the drawer is pushed in. The drawers 42, 44 seal with a lid or cover 43 when pushed in to the closed position. The structure of the drawers 42, 44 and the racks therein are conventional.

In the drawer-style dishwasher 40, a water nozzle 46 is mounted on the rear wall 48 of each drawer 42, 44. A disk 50 is mounted on the bottom of each lid 43 for rotation about a vertical axis. Each disk 50 includes a plurality of vanes 56. Alternatively, a pair of water nozzles 46 and a pair of disks 50 may be provided for each drawer 42, 44, similar to FIG. 3.

In operation, the upper water nozzle 46 directs a water jet in a substantially horizontal direction, as indicated by arrow 58, so as to have linear kinetic energy. The water jet impinges upon the vanes 56 of the disk 50, thereby rotating the disk 50 to redirect the water jet in a radial pattern, such that the water is distributed throughout the chamber of the drawers 42, 44.

Thus, the water distribution system of the dishwasher 40 functions in the same manner as the water distribution system for the dishwasher 10.

Each of the illustrated and described dishwashers show the water nozzles mounted on the back wall. It would also be equally feasible to mount the water nozzles to one of the side walls or even to the top wall of the dishwasher.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A water distribution system for a dishwasher having a washing chamber defined by opposite side walls, a bottom wall, a top wall, a back wall, and a door, the water distribution system comprising:

a disk having an upward facing surface, a downward facing surface and an outer peripheral edge, the disk being mounted on the top wall for rotation about a vertical axis, the disk having a plurality of vanes extending vertically from the upward facing surface toward the top wall and horizontally from about the axis of rotation to about the peripheral edge, the plurality of vanes forming a plurality of openings along the peripheral edge of the disk; and a water nozzle positioned at a distance greater than a radius of the disk from the axis of rotation of the disk on one of the back wall, side walls, or top wall, the water nozzle configured and arranged to project a single water jet substantially horizontally and with linear kinetic energy along a line lying in a plane, the single water jet being directed by the nozzle generally radially inwardly towards the axis of rotation of the disk into the plurality of openings to rotate the disk and thereby redirect the water radially outwardly horizontally with radial kinetic energy substantially co-planar with the linear kinetic energy of the single water jet, for distribution of the water in the washing chamber.

2. The water distribution system of claim 1, wherein the bottom wall, back wall and door of the dishwasher comprise a drawer and the top wall comprises a lid.

3. The water distribution system of claim 1 further comprising a second disk with a plurality of vanes mounted on the top wall for rotation about a second vertical axis of rotation and a second water nozzle positioned at a distance greater than a radius of the second disk from the second axis of rotation on one of the top wall or side walls, the second water nozzle configured and arranged to project a single water jet substantially horizontally and with linear kinetic energy directed generally radially inwardly towards the second axis of rotation along a line lying in a plane, the single water jet being directed by the nozzle generally radially inwardly towards the second axis of rotation of the disk and onto the vanes of the second disk to rotate the disk and thereby redirect the water radially outwardly horizontally with radial kinetic energy directed radially outwardly substantially co-planar with the linear kinetic energy of the single water jet, for distribution of the water in the washing chamber.

4. The water distribution system of claim 1, wherein the nozzle is positioned on a side wall comprising a back wall.

5. A dishwasher comprising:

a washing chamber defined by side walls, a bottom wall, and a top wall;

a disk mounted on the top wall for rotation about a vertical axis of rotation, the disk having a plurality of vanes; and a water nozzle positioned at a distance greater than a radius of the disk from the axis of rotation of the disk on one of the top wall or side walls, the water nozzle configured and arranged to project a single water jet substantially horizontally and with linear kinetic energy directed generally radially inwardly towards the axis of rotation along a line lying in a plane, the single water jet being directed by the nozzle generally radially inwardly towards the axis of rotation of the disk and onto the vanes of the disk to rotate the disk and thereby redirect the water radially outwardly horizontally with radial kinetic energy directed radially outwardly substantially co-planar with the linear kinetic energy of the single water jet, for distribution of the water in the washing chamber.

6. The dishwasher of claim 5 further comprising a second disk with a plurality of vanes mounted on the top wall for rotation about a second vertical axis of rotation and a second water nozzle positioned at a distance greater than a radius of the second disk from the second axis of rotation on one of the top wall or side walls, the second water nozzle configured and arranged to project a single water jet substantially horizontally and with linear kinetic energy directed generally radially inwardly towards the second axis of rotation along a line lying in a plane, the single water jet being directed by the nozzle generally radially inwardly towards the second axis of rotation of the disk and onto the vanes of the second disk to rotate the disk and thereby redirect the water radially outwardly horizontally with radial kinetic energy directed radially outwardly substantially co-planar with the linear kinetic energy of the single water jet, for distribution of the water in the washing chamber.

7. The dishwasher of claim 5, wherein the nozzle is positioned on a side wall comprising a back wall.

8. The water distribution system according to claim 5, wherein the bottom wall, back wall and door of the dishwasher comprise a drawer and the top wall comprises a lid.

9. A dishwasher comprising:

a washing chamber defined by side walls, a bottom wall, and a top wall;

at least one rack positioned in the washing chamber positioned for washing objects in the rack;

a disk mounted on the top wall within the washing chamber and above the rack for rotation about a vertical axis of rotation, the disk having a plurality of vanes, each vane having a vertical extent and substantially greater horizontal extent, with the vertical extent remaining vertical as the disk rotates about the axis of rotation; and a water nozzle positioned at a distance greater than a radius of the disk from the axis of rotation of the disk on one of the top wall or side walls, the water nozzle configured and arranged to project a single water jet substantially horizontally and with linear kinetic energy directed generally radially inwardly towards the axis of rotation along a line lying in a plane, the single water jet being directed by the nozzle generally radially inwardly towards the axis of rotation of the disk and onto the vanes of the disk to rotate the disk and thereby redirect the water radially outwardly horizontally with radial kinetic energy directed radially outwardly substantially co-planar with the linear kinetic energy of the single water jet, for distribution of the water in the washing chamber.

10. The dishwasher of claim 9 further comprising a second disk with a plurality of vanes mounted on the top wall for rotation about a second vertical axis of rotation and a second water nozzle positioned at a distance greater than a radius of the second disk from the second axis of rotation on one of the top wall or side walls, the second water nozzle configured and arranged to project a single water jet substantially horizontally and with linear kinetic energy directed generally radially inwardly towards the second axis of rotation along a line lying in a plane, the single water jet being directed by the nozzle generally radially inwardly towards the second axis of rotation of the disk and onto the vanes of the second disk to rotate the disk and thereby redirect the water radially outwardly horizontally with radial kinetic energy directed radially outwardly substantially co-planar with the linear kinetic energy of the single water jet, for distribution of the water in the washing chamber.

11. The dishwasher of claim 9, wherein the nozzle is positioned on a side wall comprising a back wall.

12. The dishwasher of claim 9, wherein the bottom wall, back wall and door of the dishwasher comprise a drawer and the top wall comprises a lid.

* * * * *